US006600403B1

(12) United States Patent
Rittner et al.

(10) Patent No.: US 6,600,403 B1
(45) **Date of Patent: *Jul. 29, 2003**

(54) PLANAR INDUCTOR

(75) Inventors: Ulrich Rittner, Rosengarten (DE); Heiner Schmidt, Rosengarten (DE)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/565,775

(22) Filed: Dec. 1, 1995

(30) Foreign Application Priority Data

Dec. 2, 1994 (DE) ..... P 4442994

(51) Int. Cl.[7] ..... H01F 5/00
(52) U.S. Cl. ..... 336/200; 336/223; 336/232
(58) Field of Search ..... 336/200, 232

(56) References Cited

U.S. PATENT DOCUMENTS

| | | | | | |
|---|---|---|---|---|---|
| 3,505,569 | A | * | 4/1970 | Schweizerhof | 336/200 |
| 3,614,554 | A | * | 10/1971 | Richardson | 336/200 |
| 3,798,059 | A | | 3/1974 | Astle et al. | 117/212 |
| 3,858,138 | A | * | 12/1974 | Gittleman et al. | 336/200 |
| 3,881,244 | A | * | 5/1975 | Kendall | 336/200 |
| 5,479,695 | A | * | 1/1996 | Grader et al. | 336/200 |

FOREIGN PATENT DOCUMENTS

| | | | | |
|---|---|---|---|---|
| DE | 2441317 | | 3/1976 | H01F/17/00 |
| DE | 132226 | * | 9/1978 | 336/200 |
| EP | 0310396 | | 4/1989 | H01F/5/00 |
| JP | 47-21490 | * | 6/1972 | 336/200 |
| JP | 56-096811 | | 8/1981 | |
| JP | 61-100910 | | 9/1986 | |
| JP | 4-79305 | * | 3/1992 | 336/200 |
| JP | 4-84404 | * | 3/1992 | 336/200 |
| JP | 5-67526 | * | 3/1993 | 336/200 |

OTHER PUBLICATIONS

"Etched Transformer", Crawford et al, IBM Technical Disclosure Bulletin, vol. 8, No. 5, Oct. 1965, p. 723, 336–200.*

* cited by examiner

*Primary Examiner*—Anh Mai
(74) *Attorney, Agent, or Firm*—Dicran Halajian

(57) ABSTRACT

A planar inductor having at least a helical coil and a coating of ferromagnetic material deposited on a flat carrier. The inductance and/or the magnetic coupling of a plurality of coils or windings of the inductor can be precisely set through the ferromagnetic material, which is inside an insulant window that is fixed to the carrier, being deposited on the carrier during the coating process.

6 Claims, 2 Drawing Sheets

PLANAR INDUCTOR

BACKGROUND OF THE INVENTION

This invention relates to a planar inductor comprising at least an essentially spiral coil deposited on a flat carrier and a coating essentially of a ferromagnetic material deposited on this carrier.

From DE-OS 24 41 317 is known a method for adjusting the inductance of flat coils which are manufactured in film technology. In this method, depending on the deviation of the actual inductance value from the set inductance value, a larger or smaller part of the flat coil is covered with a paste consisting of a magnetizable powder mixed with a bonding agent, or the thickness of the covering paste is increased, respectively. For adjusting the inductance of the flat coil, a part of the coil surface that is defined by an angle of coverage is covered with the paste. The angle of coverage is linearly related to the change of the inductance, but the thickness of the paste has a non-linear effect on the change of the inductance. The document describes that the adjusting process for the inductance by covering the flat coil with the paste can be automated.

EP-OS 310 396 has disclosed a planar inductor which has helical conductor coils which are sandwiched between ferromagnetic layers with interposed insulating layers. The helical conductor coils form two coils of the same contour which are arranged flush with and close to each other. Furthermore, the two helical coils are electrically connected to each other so that currents of different directions flow through the individual coils. Furthermore, the ferromagnetic layers have a surface that is larger than the sum of the surfaces of the two conductor coils. Such an arrangement prevents a lowering of the inductance when the individual components are bonded together and achieves an increase of the inductance value per volume unit.

The inductors represented in that document, however, are made of a large number of layers or rectangles of insulating material or ferromagnetic components in a relatively complex manner. On the one hand, this considerably increases the cost of production and, on the other hand, it provides neither a possibility for a variation of the magnetic coupling during manufacture, nor for an adjustment.

SUMMARY OF THE INVENTION

It is an object of the invention to provide a planar inductor in such a way that its inductance value can be adjusted or set precisely with simple means during manufacture and/or that the magnetic coupling of a plurality of coils or windings respectively, of an inductor can be set precisely with accordingly simple means.

This object is achieved with a planar inductor of the type defined in the opening paragraph in that the ferromagnetic material inside an insulant window fixed to the carrier is deposited on the carrier during coating process.

Planar inductors of the type according to the invention can advantageously be used in hybrid technology or multichip modular technology in which a plurality of electronic elements, which may be integrated circuits, are deposited on a planar carrier, for example, on a PC board. This planar carrier has a conducting layer from which predefined line structures have been cut out, preferably via etching technology. These (electroconductive) line structures are used for the electrical connection of the components deposited on the carrier. In addition, from these line structures it is also possible to form preferably planar inductors which can be manufactured in a simple, precise and robust manner. For mechanically protecting such planar carriers which accommodate components, a protective layer is finally deposited in a so-called coating process, which protective layer consists of a hardening coating material which envelops the components and their connections.

If only some areas of the carrier accommodate components in a specific embodiment of an electronic circuit manufactured in this manner, whereas other areas of the carrier may have line structures (printed lines), it is advantageous to cover with a coating material only those areas of the, carrier that accommodate components. Before this coating material is applied in a defined manner, insulant windows are applied first, e.g. stuck onto the carrier, which windows surround the component-accommodating areas of the carrier surfaces like a frame. During the coating process, the coating material is then applied inside these insulant windows.

In the case of the planar inductor according to the invention, an insulant window is also applied over the coil or coils, respectively. This window can surround the whole planar inductor, but also overlap it only partly. Also the height of the insulant window perpendicularly to the surface of the carrier may be selected to be different; for this purpose, preferably a height is used that is also used for the covering of further said components, so that a simplification and uniformity during manufacture is achieved. As a result of the dimensions of the insulant window parallel to the surface of the carrier, and as a result of the positioning of the insulant window over a larger or smaller part of the whole surface of the carrier covered by the planar inductor, the inductance value or coupling respectively, between a plurality of coils of the planar inductor can be set. The insulant window is filled with ferromagnetic material during the coating process. In principle, the same manufacturing steps and methods as used for the covering of the components mentioned before greatly simplify the manufacture. Also substantially the same coating material is used; only a ferromagnetic addition to this material is used to increase the magnetic coupling or inductance value, respectively. In this manner the ferromagnetic material can be obtained in a very simple manner from the covering agent which is also designated as the coating material, while the mixing ratio of the ferromagnetic addition to the coating material and the amount of material applied in the respective insulant window can be selected to set the coupling or inductance, respectively. Preferably, these parameters may be determined in such a way that for a specific planar inductor to be manufactured, size, shape and position of the insulant window, as well as the composition of the ferromagnetic material, are to be given fixed, predefined values. By dosing the amount of ferromagnetic material when deposited on the carrier inside the insulant window, the inductance or coupling respectively, can then be set exactly to the desired value, as appropriate, in that the electrical measurement is adjusted while the ferromagnetic material is being deposited. The insulant window then renders the manufacturing process very well controllable mechanically, i.e. very close tolerances can be attained with little expenditure.

The dependent claims show advantageous embodiments of the planar inductor according to the invention.

With the embodiment of the planar inductor according to the invention—especially when the coil(s) is (are) covered completely—it is possible for the ferromagnetic material to provide at the same time a mechanical protection of line structures, especially of connecting wires. Since the ferromagnetic material is preferably non-conductive, in one operation it is possible for this material to cover as a mechanical protection not only the planar inductor, but also adjacent electronic components. The influence of the ferromagnetic material on the line structures and their transmission properties is then to be taken into account accordingly.

With the currently known coating materials and ferromagnetic additions, in the case of an unchanged compact line structure for a planar inductor of the type according to the invention, it is also possible to achieve an enhancement of the quality of the inductances, i.e. of the ratios of the inductance values to the ohmic resistances of the line structures, in addition to providing a setting and specifically an increase of the magnetic coupling or inductance values, respectively. When used, for example, in frequency-selective circuits for communication technology, this may lead to an improvement of the transmission behaviour of the circuit.

These and other aspects of the invention will be apparent from and elucidated with reference to the embodiments described hereinafter.

DETAILED DESCRIPTION OF THE PREFERRED EMBODIMENTS

Figure 1:
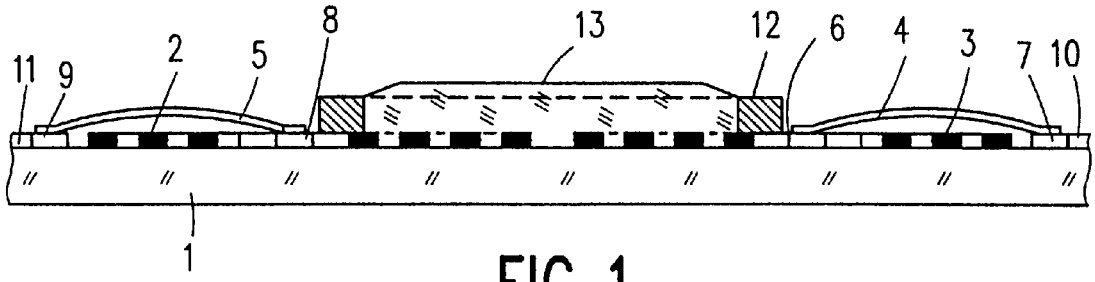
FIG. 1 shows a first illustrative embodiment of a planar inductor according to the invention in plan view.

In the diagrammatic representation shown in FIG. 1, the reference character 1 designates a detail of a planar carrier as it is preferably used in hybrid technology or multichip modular technology. On this planar carrier are arranged two planar, essentially flat spiral-shaped coils 2 and 3 which are preferably deposited on the planar carrier in the form of a so-called printed line structure. Bonding wires 4 and 5 form connecting bridges between lands 6, 7 and 8, 9, respectively, and thus establish a conducting connection between the coil ends in the centres of the spirals and line structures 10 and 11 respectively, arranged outside of the spirals. The planar carrier 1 carries further components, also integrated circuits in the form of doped semiconductor bodies—not shown in FIG. 1—whose electrical connections are established via line structures which correspond to those of the coils 2 and 3 respectively, or the line structures 10, 11, and can be manufactured in the same manufacturing process.

The planar carrier 1 accommodates an insulant window 12—partly covering the coils 2 and 3—and this window is stuck onto the carrier 1. The mounting of this insulant window 12 may preferably be included in the manufacturing step of said further components (not shown). The part of the surface of the carrier 1 enclosed by the insulant window 12 is covered with a ferromagnetic material 13, a mixture of a coating material and a ferromagnetic addition which can be applied in a liquid condition to the insulant window and hardens there.

Figure 2:
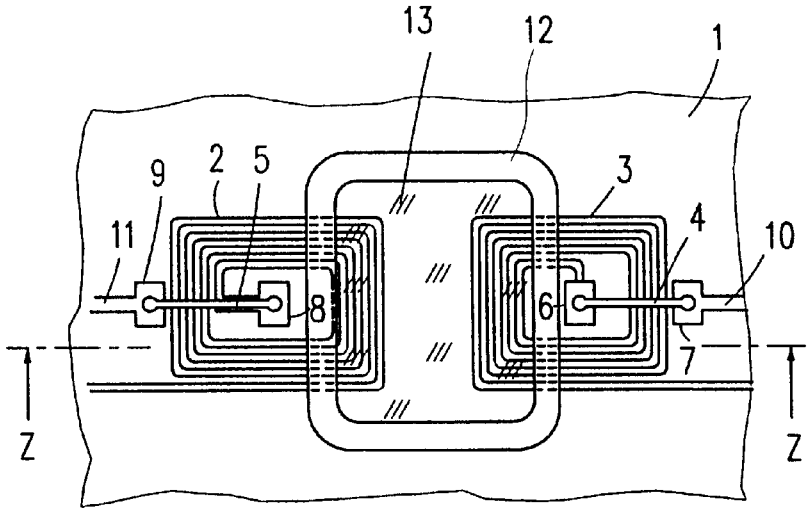
FIG. 2 shows a section through the planar inductor as shown in FIG. 1.

FIG. 2 shows the planar inductor on the flat carrier in longitudinal section. Also this representation especially shows the material thicknesses in a diagrammatic way only.

In the illustrative embodiment shown in FIG. 2 the ferromagnetic material 13 covers only part of the planar inductor; that is to say the bonding wires 4 and 5 remain unprotected. For their mechanical protection it is advantageous to form the insulant window 12 in such a way that the whole planar inductor including the associated bonding wires and connections are enclosed as much as possible and can be covered with ferromagnetic material. Such an arrangement is shown, for example, in FIG. 3 in plan view in which a modified form with interleaved helical coils is chosen. In this drawing Figure a second coil 21 between lands C and D is surrounded by a first coil 20 between lands A and B. Bonding wires 22, 23 connect the lands B and C and D to line structures 24 so as to connect the inner coil lines of the planar inductor to externally located parts (not shown in FIG. 3) of a circuit present on carrier 1. The ferromagnetic material 13 then covers the whole planar inductor.

Figure 3:
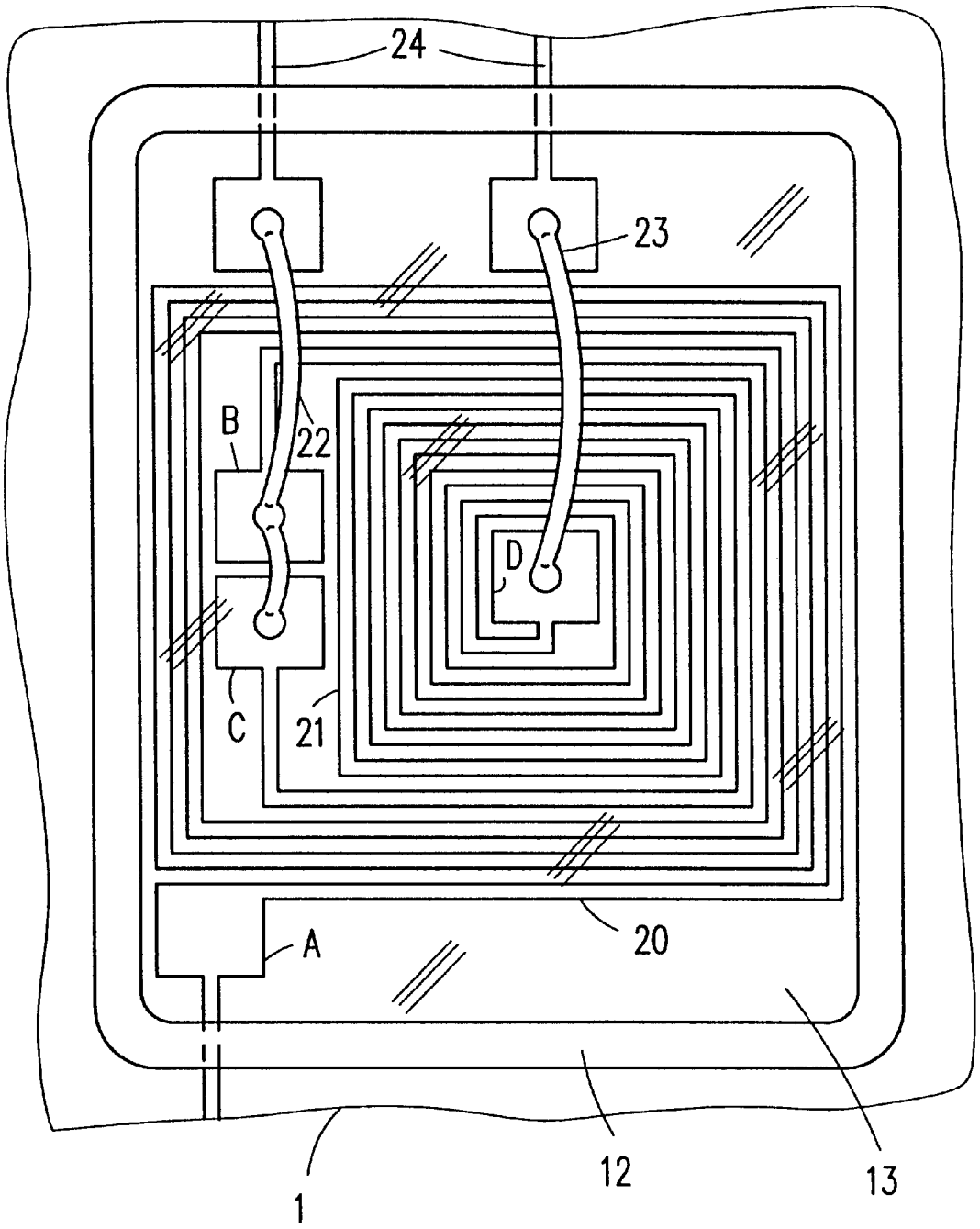
FIG. 3 shows a second illustrative embodiment of a planar inductor according to the invention.

Especially in the illustrative embodiment shown in FIG. 3, the arrangement of coils 20 and 21 can be used for different functions or proportions. By accordingly changing the bonding wires 22, 23, the first coil 20 or second coil 21 respectively, alone, a codirectionally coiled series combination of the coils 20, 21, or a reversely coiled series combination of the coils 20, 21 can optionally form the desired inductor. With unchanged geometry of the planar inductors, this desired inductor can therefore achieve different proportions only with differently led bonding wires for different applications, as a result of which larger inductance values can be developed together with the ferromagnetic material. The arrangement of the bonding wires 22, 23 shown in FIG. 3 shows a further possibility of connecting the coils 20, 21, that is to say, as a transformer. Preferably the lands A to D can be individually connected to external components, especially electronic switches through which these different interconnections can be realised selectively.

The examples shown in the drawing Figures may be modified in many respects. For example, further line structures or components can be arranged on the back of the carrier 1. It is also possible to utilize flat carriers that have a multilayer structure of a line structure alternating with an insulating layer. The surfaces of the carrier 1 outside the insulant window 12 can be covered with the covering agent or with a coating material that does not contain a ferromagnetic addition. At any rate, it is possible to manufacture even complex circuit arrangements in simple manufacturing steps. No further machines, apparatus or devices are necessary then in addition to the manufacturing equipment already used for hybrid technology or multichip modular technology, because the manufacture and adjustment of the planar inductors according to the invention may be effected within the normal manufacturing steps for hybrid technology or multichip modular technology, respectively.

What is claimed is:

1. A planar inductor device comprising:

a flat carrier, at least one essentially flat spiral-shaped coil deposited on a surface of the flat carrier, an insulant window frame fixed to the surface of the carrier so as to form a border encircling at least a portion of the spiral-shaped coil, and a coating of ferromagnetic material deposited on the surface of the flat carrier and on a portion of the spiral-shaped coil within the border of the insulant window frame.

2. The planar inductor device as claimed in claim 1 further comprising at least one bonding wire coupling an inner end of the coil located within the coil to a conductor located outside of the coil, wherein the end of the bonding wire within the coil is outside of the insulant window frame.

3. The planar inductor device as claimed in claim 1 further comprising at least one bonding wire coupling an inner end of the coil located within the coil to a conductor located outside of the coil, wherein the end of the bonding wire within the coil is positioned within the border of the insulant window frame.

4. The planar inductor device as claimed in claim 1 wherein the coating of ferromagnetic material comprises a mixture of a coating material and a ferrite powder.

5. The planar inductor device as claimed in claim 1 wherein at least one coil parameter including coil inductance and coil coupling is determined by at least one parameter comprising insulant window alignment relative to the at least one flat spiral-shaped coil, insulant window contour, thickness of deposited ferromagnetic material and composition of the ferromagnetic material.

6. The planar inductor device as claimed in claim 1 wherein the coating of ferromagnetic material is electrically non-conductive and the insulant window frame has a planar structure.

* * * * *